US007784584B2

(12) United States Patent
Gonzalez

(10) Patent No.: US 7,784,584 B2
(45) Date of Patent: Aug. 31, 2010

(54) DEVICE FOR REDUCING NOISE AND HEAT EMISSIONS

(76) Inventor: Alvaro Gonzalez, Kannenfeldstrasse 25, Basel (CH) 4056

( * ) Notice: Subject to any disclaimer, the term of this patent is extended or adjusted under 35 U.S.C. 154(b) by 249 days.

(21) Appl. No.: 11/857,109

(22) Filed: Sep. 18, 2007

(65) Prior Publication Data

US 2008/0066996 A1 Mar. 20, 2008

(30) Foreign Application Priority Data

Sep. 18, 2006 (CH) ..... 1478/06

(51) Int. Cl.
*A47B 81/06* (2006.01)

(52) U.S. Cl. ..... 181/198; 181/290; 181/200; 181/201; 181/202

(58) Field of Classification Search ..... 181/198, 181/290, 200, 201, 202
See application file for complete search history.

(56) References Cited

U.S. PATENT DOCUMENTS

| | | | | |
|---|---|---|---|---|
| 3,815,965 | A * | 6/1974 | Ostwald | 312/100 |
| 4,264,282 | A * | 4/1981 | Crago | 417/243 |
| 4,461,666 | A * | 7/1984 | Kohn | 156/222 |
| 5,123,874 | A | 6/1992 | White | |
| 5,672,052 | A * | 9/1997 | Ishida et al. | 417/312 |
| 6,481,527 | B1 * | 11/2002 | French et al. | 181/201 |
| 6,790,012 | B2 * | 9/2004 | Sharp et al. | 417/201 |
| 2002/0000342 | A1 * | 1/2002 | Yamada et al. | 181/204 |
| 2005/0275365 | A1 * | 12/2005 | Currie et al. | 318/471 |
| 2008/0053746 | A1 * | 3/2008 | Albert et al. | 181/202 |

FOREIGN PATENT DOCUMENTS

| | | |
|---|---|---|
| JP | 02231797 | 9/1990 |
| JP | 2006228924 | 8/2006 |
| WO | 2005/001215 | 1/2005 |

* cited by examiner

*Primary Examiner*—Jeffrey Donels
*Assistant Examiner*—Forrest M Phillips
(74) *Attorney, Agent, or Firm*—Cantor Colburn LLP

(57) ABSTRACT

A device (10) for reducing noise and heat emissions from a laboratory instrument in a laboratory, comprising a casing (20) with sound-absorbing walls (240), wherein the casing (20) forms an interior space (210, 220) for accommodating the laboratory instrument. At least one of the sound-absorbing walls (240) has an air inlet (30). The device (10) further has a flue (40) arranged on one of the sound-absorbing walls (240), so that the interior space (210, 220) of the casing (20) can be vented via the air inlet (30) and the flue (40). During operation of the laboratory instrument situated in the interior space (210, 220) of the device (10), the sound generated by the laboratory instrument is absorbed by the walls, so that essentially no noise, or only significantly reduced levels of noise, generated by the laboratory instrument can escape the device (10). The walls (240) and their connections are also designed in such a way that essentially no heat generated by the laboratory instrument can escape the device (10). The air that flows into the interior space through the one air inlet (30), or preferably through several air inlets (30), being again evacuated through the flue (40) makes it possible to remove waste heat produced by the laboratory instrument from the device. Such a device (10) makes it possible to operate a laboratory instrument in a laboratory without people located in the laboratory being significantly impaired by waste heat and/or noise from the laboratory instrument.

14 Claims, 6 Drawing Sheets

DEVICE FOR REDUCING NOISE AND HEAT EMISSIONS

TECHNICAL FIELD

The invention relates to a device for reducing noise and heat emissions, which can be used for various types of instruments, in particular for laboratory instruments of the kind employed in laboratories.

BRIEF DESCRIPTION OF RELATED ART

Laboratory instruments are used in many industrial and scientific processes, e.g., in analysis of the chemical and pharmaceutical industries. Such laboratory instruments are used for different purposes, e.g., for chromatography or spectroscopy, and comprise various types of instruments, such as chromatographs (gas chromatographs, liquid chromatographs, thin-film chromatographs, anion-exchange chromatographs, etc.), spectroscopes (prism spectrometers, grating spectrometers, infrared spectrometers, atomic absorption spectrometers, electron energy loss spectroscopes, time-of-flight spectrometers, mass spectrometers, optical emission spectrometers (OES), spectral analyzers, radiation detectors, semiconductor detectors, etc.) and particle accelerators (linear accelerators, Van de Graaff accelerators, tandem accelerators, dynamitrons, cyclotrons, betatrons, etc.).

So that they can be easily monitored, serviced and maintained, such laboratory instruments are set up usually in a laboratory, typically on a table, where people are simultaneously present for work purposes. Such laboratory instruments often generate noise and emit heat to the environment. This noise and emitted heat can disturb working people and negatively affect their work. In addition, several such laboratory instruments are frequently located in a single laboratory, so that noise and heat from several instruments act on people present in the laboratory at the same time.

The negative effects of noise and heat emissions on humans are sufficiently known, and have been investigated in various studies. For example, a sound that is perceived as an annoyance due to noise and persists over a prolonged period of time can reduce performance and well-being, and put stress on the body. This can end up leading to hypertonia (high blood pressure), cardiocirculatory diseases and myocardial infarction (heart attack), or reduce gastric secretion, giving rise to peptic ulcers. Other consequences of noise exposure include an elevated risk of accident resulting from a masking of warning signals.

Another problem that can be encountered in the mentioned laboratory instruments is that use is often made of auxiliary units that also cause significant noise and heat emissions. For example, numerous laboratory instruments, as for example particle accelerators, utilize vacuum pumps. As opposed to the laboratory instruments themselves, these auxiliary units usually require less monitoring, servicing and maintenance. For this reason, they are frequently positioned close to the accompanying laboratory instruments to enable easy connections with the laboratory instruments, but without satisfying any special requirements as to ready accessibility. For example, one common configuration involves positioning the laboratory instrument on a table, and placing the accompanying auxiliary unit or accompanying auxiliary units under the same table.

BRIEF DESCRIPTION OF THE INVENTION

According to the invention, a device is provided for reducing noise and heat emissions from a laboratory instrument in a laboratory as characterized by the features of the independent claim. Advantageous embodiments of the device according to the invention are described in the features of the dependent claims.

In particular, the device comprises a casing with sound-absorbing walls, wherein the casing forms an interior space for accommodating the laboratory instrument. At least one of the sound-absorbing walls has an air inlet, and the device has a flue connected with one of the sound-absorbing walls, so that the interior space of the casing is ventable via the air inlet and the flue. During operation of the laboratory instrument located inside the interior space of the device, the sound it generates is absorbed by the walls, so that essentially no noise, or only significantly reduced levels of noise, of the laboratory instrument can escape the device. Depending on the type of used laboratory instrument, the device can also comprise buffers, on which the laboratory instrument can be placed to reduce vibrations and noise. To prevent noise of escaping from the connection between the walls out of the device as well, the walls are, to more or less an extent, soundproofly interconnected. The walls and their connections are additionally arranged in such a way that essentially no heat generated by the laboratory instrument can escape the device. By means of the air that flows into the interior space through the one air inlet, or preferably through several air inlets, and that is again evacuated through the flue, waste heat produced by the laboratory instrument can be removed from the device. Such a device makes it possible to operate a laboratory instrument in a laboratory without people located in the laboratory being significantly impaired by waste heat and/or noise from the laboratory instrument.

Thereby, the flue can be connected with a ventilation system, e.g., a building ventilation system, so that the waste heat produced by the laboratory instrument can be removed from the laboratory without warming up the laboratory itself. By connecting the flue with a building ventilation system, the waste heat can be simultaneously used to heat the air being delivered into the building. The flue preferably has a flue connection piece on one of the walls for connecting the flue and ventilation system in this way.

The flue preferably has a fan, wherein the flue can be arranged as a pipe that houses the fan. The fan can route air from the interior space through the flue to the outside thereby generating an underpressure in the interior space. As a result of this underpressure, new air from outside the device is conveyed through the air inlet into the interior space continuously ventilating the interior space. The pipe can be set up within the interior space in such a way that the air flows through the interior space optimized to cool the laboratory instrument.

The device preferably has an insulation shell that covers the air inlet from the interior space of the casing. On one hand, such an insulation shell can be used to divert the air streaming in through the air inlet in a preferred manner, so that the interior space can be ventilated, and hence cooled, as effectively as possible. On the other hand, such an insulation shell can be used to effectively dampen noise penetrating through the air inlet from the interior space. Thereby, the insulation shell can have a sound dampening layer arranged on a plate, e.g., a plate made out of metal.

Preferably the interior space is separated by an intermediate wall into a first interior space and a second interior space. Thereby, the intermediate wall has an air passage that connects the first interior space with the second interior space. Thereby, the insulation shell is arranged to divert air streaming through the air inlet into the interior space in such a way that the air is routable through the air passage, and both the first interior space and the second interior space are ventilatable via the air inlet and the flue. In such a configuration, another instrument can be arranged in the same device separately from the laboratory instrument, wherein the first interior space is preferably situated on top of the second interior space. In particular when using the laboratory instrument, e.g., a particle accelerator, and an auxiliary unit belonging thereto, e.g., a vacuum pump, the auxiliary unit can hence be placed in the lower second interior space, and the laboratory instrument in the upper first interior space. The higher location of the first interior space makes the laboratory instrument readily accessible to a person for monitoring, servicing and maintenance.

The air inlet is here advantageously situated in the area of the second interior space. Thereby, the air passage has at least one inlet passage to route air from the second interior space into the first interior space, and at least one outlet passage to route air from the first interior space into the second interior space. As a result, the air can be routed in a preferred manner through both the first interior space and the second interior space, thereby yielding a continuous circulation of air through the first interior space and the second interior space.

The insulation shell preferably comprises a first shell section, which covers the air inlet from the second interior space, and a second shell section, which covers the air passage, and in particular its at least one inlet passage, from the second interior space, wherein the first shell section is tightly connected with the second shell section. Such an insulation shell can be used to route the air through the air inlet into the second interior space, from there along the first shell section and second shell section through the air passage into the first interior space, and from there in turn out of the first interior space via the flue.

In an embodiment of the air passage with an inlet passage and outlet passage, another insulation shell can also cover the at least one outlet passage from the interior space, wherein it can also be connected with the flue. As a result, the exhaust air exiting the first interior space via the outlet passage can be directly removed form the device without having to pass through and perhaps heat the second interior space.

The casing advantageously has a frame and panels arranged therein, which are sealedly connected with the frame. Since laboratory instruments and their auxiliary units are typically relatively heavy, the device preferably has a stable design. Such a frame can be used to easily impart the corresponding structural stability to the device. The frame, e.g., one made out of steel, can also be partially hollowed out to keep the weight of the device down as much as possible.

The panels preferably have a wood core mounted in steel elements, in particular a wood core made out of compressed wood. Such panels, in particular ones sealed with steel plates, have preferred sound absorption properties and heat retention properties on one hand, and enable a stable configuration of the device on the other hand, making it suitable for relatively heavy laboratory instruments.

The flue preferably has a fan, which is controllable by means of a temperature sensor. Thereby, the temperature sensor is preferably situated in the interior space. A controller regulates the speed of rotation of the fan, so that more air is conveyed through the device when the temperature sensor detects a higher temperature, and less air is conveyed through the device when the temperature sensor detects a lower temperature.

One of the casing walls can be arranged as a door for opening the interior space, wherein preferably at least two of the walls are arranged as doors, so that both the first interior space and second interior space can be opened. Such doors, each being tightly sealed when closed, can be used to easily gain access to the first interior space or the second interior space, respectively. Since the doors can be relatively heavy, e.g., when made out of a wood core mounted in steel plates, the device preferably has gas springs for support in opening and closing the doors.

Rolls are advantageously arranged on the casing for moving the device. Since the device can be very heavy as described above, e.g., weighing roughly 500 kilograms, and additionally heavy laboratory instruments and auxiliary units can also be arranged in the device, such rolls allow a person to move the device.

BRIEF DESCRIPTION OF THE DRAWINGS

Additional advantageous embodiments of the invention can be gleaned from the following description of exemplary embodiments of the invention with the help of the schematic drawing, wherein.

DETAILED DESCRIPTION OF THE INVENTION

Figure 1:
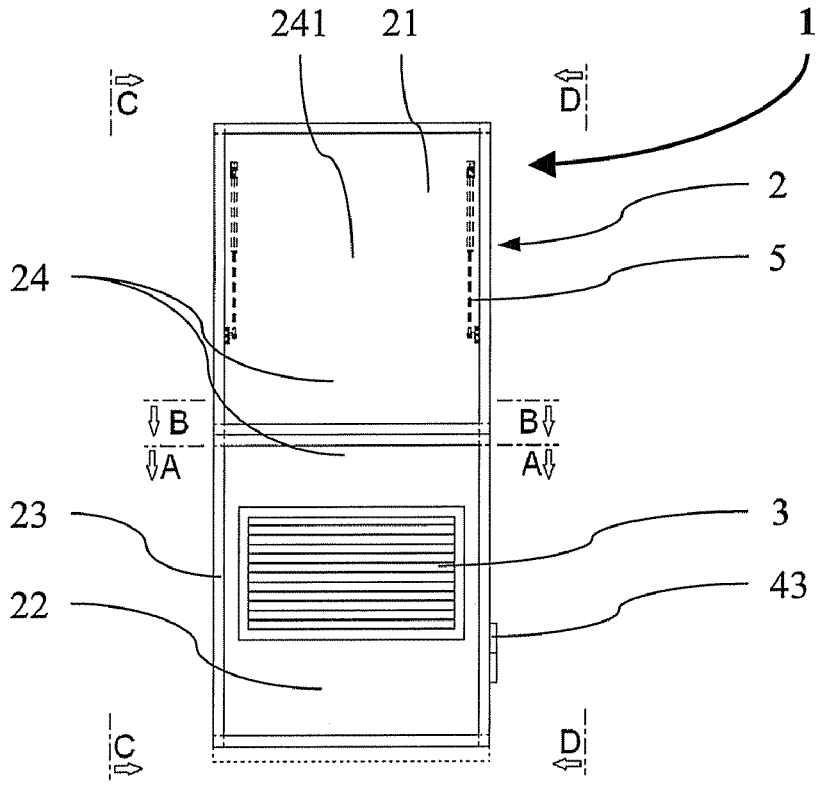
FIG. 1 shows a side view of a first exemplary embodiment of a device according to the invention for reducing noise and heat emissions from a laboratory instrument in a laboratory.

Certain terms are used in the following description for practical reasons, and must not be construed as limiting. The words "right", "left", "bottom" and "top" denote directions in the drawing to which reference is made. The terms "inward" and "outward" denote directions toward or away from the geometric midpoint of the device and specified parts thereof. The terminology comprises the words expressly mentioned above, derivations of the latter, as well as words similar in meaning.

FIG. 1 shows a side view of a first exemplary embodiment of a device 1 according to the invention having a casing 2 with a frame 23 and panels 24 arranged therein. The panels 24 are tightly connected with the frame 23 in such a way as to form an upper first interior space 21 and a lower second interior space 22 separated from it by an intermediate wall (not visible on FIG. 1). The panel 24 of the first interior space 21 shown in the side view on FIG. 1 is arranged as a swinging gate 241, which can be swiveled up by means of two gas springs 5, so that the first interior space 21 can be opened, making it accessible from the side. The panel 24 of the second interior space 22 shown in the side view on FIG. 1 accommodates an air inlet 3, through which air can stream into the second interior space 22. The device 1 has a flue connection piece 43 that projects over the casing 2, as shown on the right side of the side view on FIG. 1.

The following statement applies to the entire remaining description. If, for purposes of clarity in the drawing, a figure contains reference signs but these are not mentioned in the text of the description relating directly thereto, reference is made to their explanation in preceding figure description.

Figure 2:
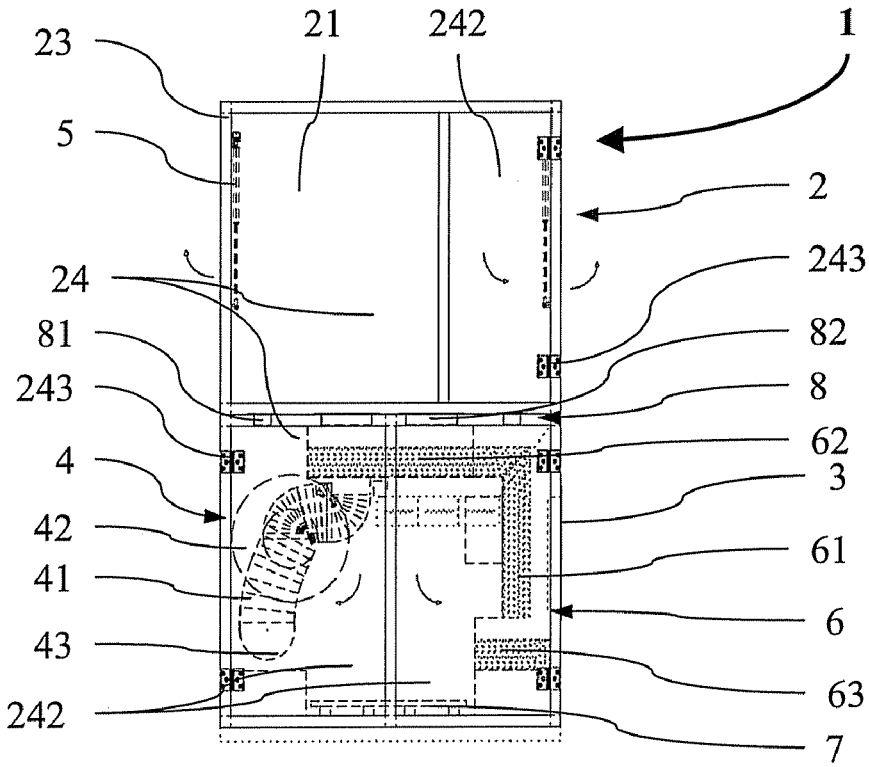
FIG. 2 shows a front view along line C-C of the device from FIG. 1.

FIG. 2 shows a front view of the device 1, wherein the side view of the device 1 shown in FIG. 1 with the air inlet 3 is on the right side. FIG. 2 also depicts specific elements located inside the device 1 with dashed lines. The first interior space 21 is sealed off to the front by two horizontally adjacent panels 24, wherein the right panel 24 is designed as a door 242 secured to the frame 2 by two hinges 243. All doors 242 and swinging gates 241 open in directions denoted by the curved arrows in the drawings. The mentioned door 242 of the first interior space 21 can be swiveled to the right, so that the first interior space 21 can be opened and also accessed from the front side. The second interior space 22 is also sealed to the front by two horizontally adjacent panels 24, wherein both panels are designed as doors 242 each secured to the frame 2 by two hinges 243. The two doors 242 of the second interior space 22 can be swiveled outwardly, so that the second interior space 22 can also be opened and accessed from the front. As denoted by the gas spring 5 and correspondingly curved arrow, the panel on the side of the first interior space 21 opposite the side shown on FIG. 1 is designed as a swinging gate 241.

Between the first interior space 21 and the second interior space 22 an air passage 8 is arranged, which has edge passages 81 located toward the left or right end of the device 1 as inlet passages, and two central passages 82 arranged in the middle as outlet passages. A vertical first shell section 61 of an insulation shell 6 covers the air inlet 3 to the inside. The insulation shell 6 has a sheet to which an insulating material is applied. A horizontal second shell section 62 forms a tight upper seal with the first shell section 61, and covers the central passages 82. A horizontal third shell section 63 is situated below, spaced apart from the first shell section 61.

The interior space 22 also incorporates a flue 4, which comprises a pipe 41 that is connected airtight with the second shell section 62 at its one end, and empties in the flue connection piece 43 at its other end. To the pipe 41 a fan 42 is arranged, which is functionally connected with the pipe 41 in such a way that the fan 42 can convey air in the direction of the flue connection piece 43 through the pipe 41. The floor of the second interior space 22 has a horizontally buffered receptacle 7 for carrying an instrument that can absorb vibrations and sound produced by a device.

Figure 3:
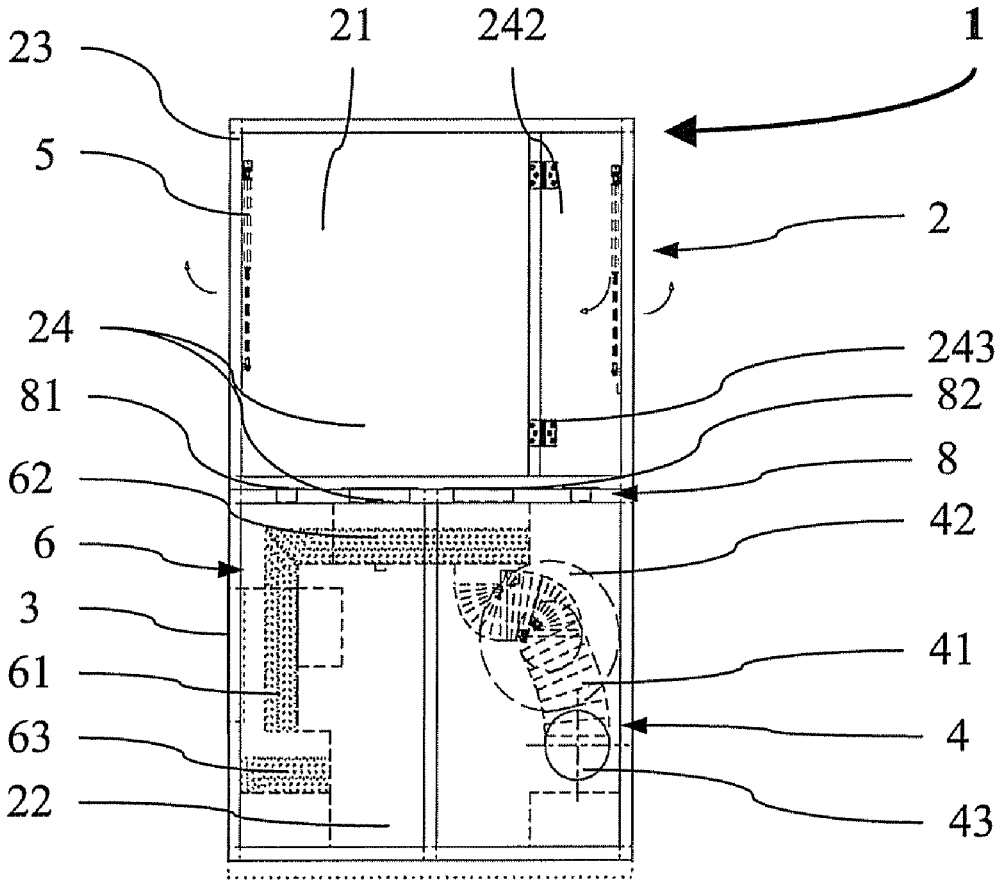
FIG. 3 shows a rear view along line D-D of the device from FIG. 1.

FIG. 3 shows a rear view of the device 1. The first interior space 21 and the second interior space 22 each are sealed to the back by respective two horizontally adjacent panels 24. The right panel 24 of the first interior space 21 is a door 242 secured by two hinges 243 to the frame 2, which can be swiveled to the left, so that the first interior space 21 can be opened and also accessed from the back. The flue connection piece 43 is situated on the right panel 24 of the second interior space 22.

Figure 4:
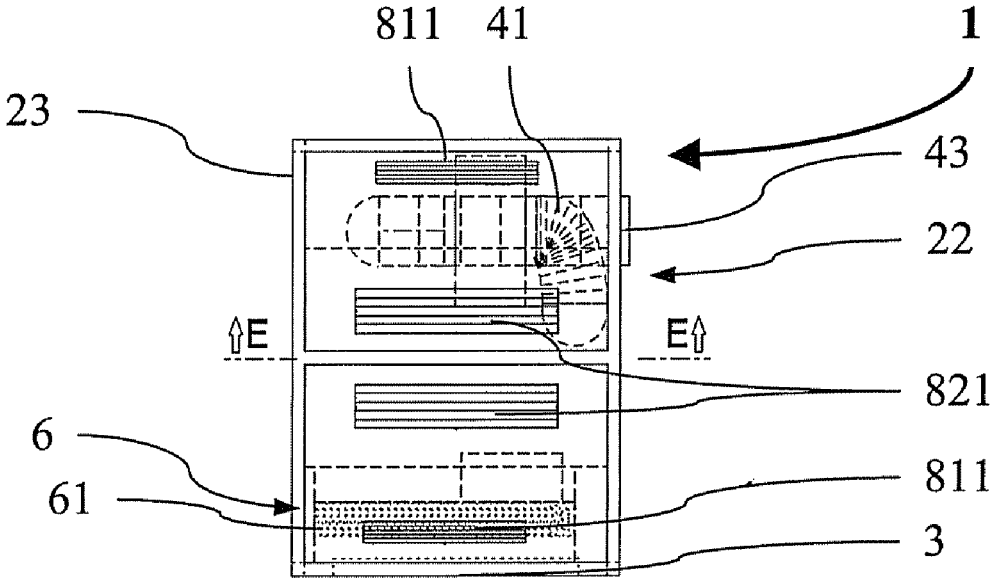
FIG. 4 shows a sectional view along line A-A of the device from FIG. 1.

In FIG. 4 a top view into the second interior space 22 is shown. The two edge passages 81 and the two central passages 82 each exhibit a grid 811 and 821.

Figure 5:
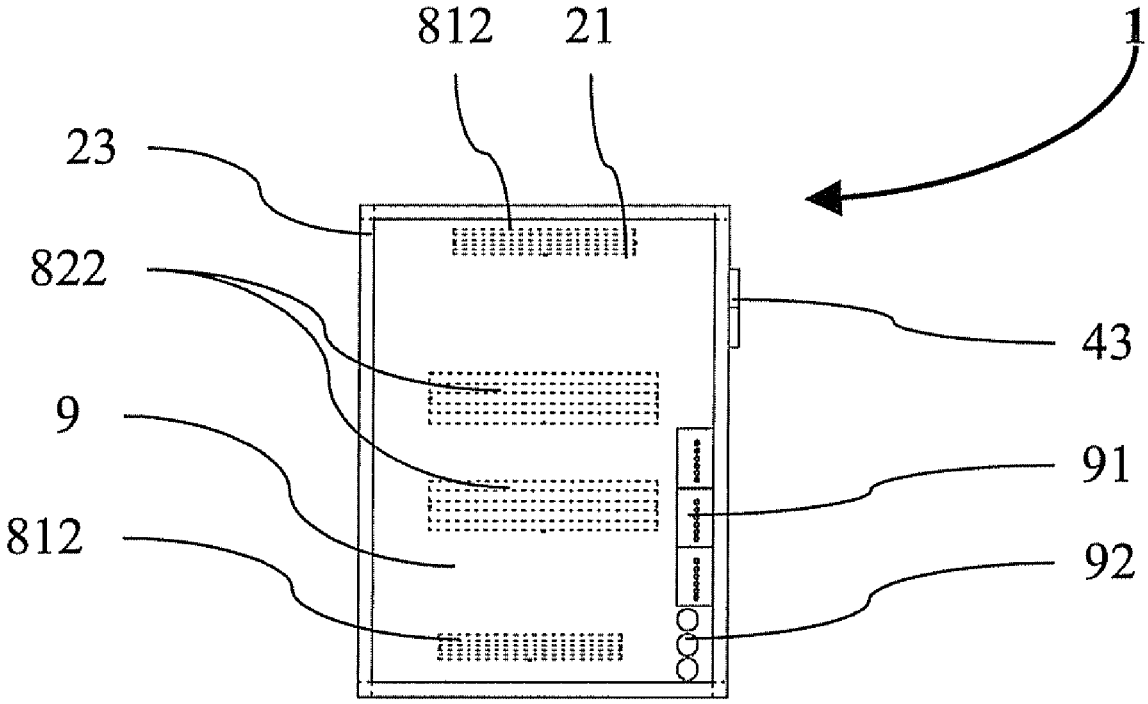
FIG. 5 shows a sectional view along line B-B of the device from FIG. 1.

FIG. 5 shows a view on the intermediate wall 9, which is tightly connected with the frame 23 and separates the first interior space 21 from the second interior space 22. The intermediate wall 9 exhibits perforated screens 812 and 822 that abut the grids 811 of the edge passages 81 and the grids 821 of the central passages 82. The intermediate wall 9 also has cable passages 91 and line passages 92, which can be used to arrange cables or lines so that the first interior space 21 tightly adjoins the second interior space 22.

Figure 6:
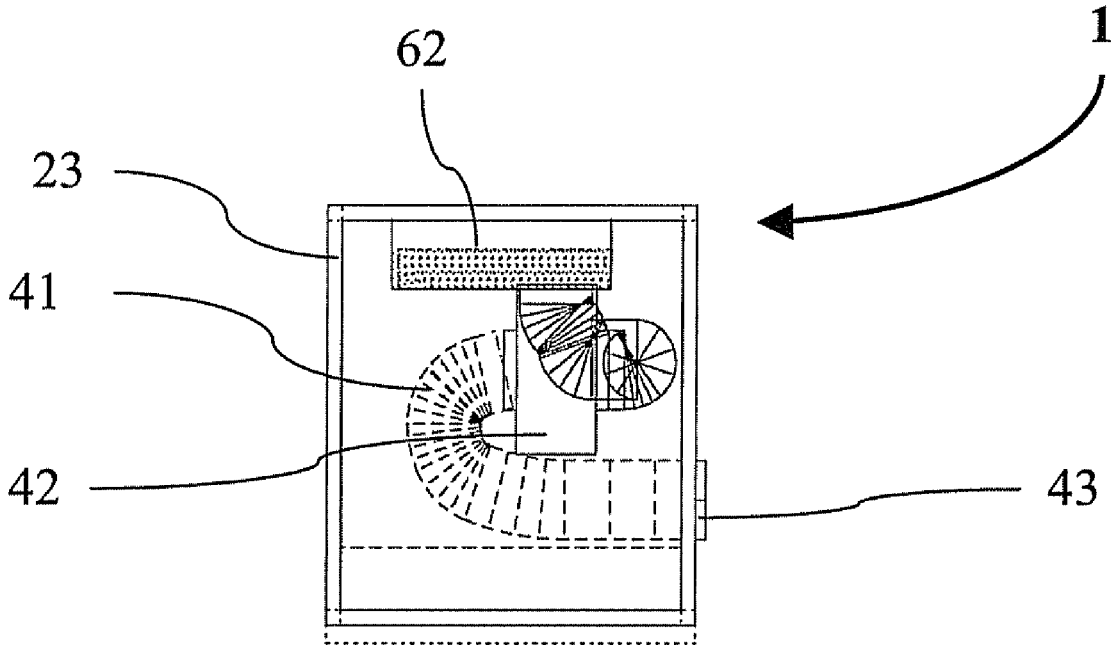
FIG. 6 shows a sectional view along line E-E of the device from FIG. 4.

In FIG. 6 the design of the flue 4 is shown, wherein the pipe 41 is connected with the second shell section 62 in such a way as to let air through, and empties into the flue connection piece 43.

During operation of the device 1, a laboratory instrument, e.g., a particle accelerator, can be arranged in the first interior space 21 on the intermediate wall 9, and an auxiliary unit, e.g., a vacuum pump, can be accommodated on the receptacle 7 in the second interior space 22. The laboratory instrument can be tightly wired with the auxiliary unit via the cable passages 91, which may be necessary for controlling the power of the auxiliary unit, for example. The auxiliary unit can be tightly connected with the laboratory instrument in terms of function via the line passages 92. For example, a vacuum line can be routed from the vacuum pump to the particle accelerator, and used by the vacuum pump to generate a vacuum in the particle accelerator required for operating the particle accelerator. The described configuration of the casing 2 in the area of the first interior space 21 makes it possible to open the first interior space 21 of the device 1 from all sides. As a result, the laboratory instrument can also be accessed from all sides, which is important for the simple monitoring, servicing and maintenance of the laboratory instrument.

Since the laboratory instruments and their auxiliary units are typically relatively heavy, the device 1 is massive and stable in design. The frame 23 is made out of hollow steel carriers, while the panels 24 consist of laminated wood plates mounted in steel plates. In addition to the mentioned advantageous bearing characteristics of such panels, the latter also absorb a relatively high level of sound, and are relatively poor conductors of heat, so that essentially no waste heat and noise from the laboratory instrument and auxiliary unit can exit the device 1 through the sealed casing 2. Because the air inlet 3 of the device 1 is covered by the insulation shell 6, the noise escaping through the air inlet 3 and heat exiting the air inlet 3 can also be minimized.

In order to cool the first interior space 21 and the second interior space 22, heated air is relayed through the central passages 82, the pipe 41 and the flue connection piece 43 out of the first interior space 21 and out of the device 1 by the fan 42. This produces an underpressure in the first interior space 21, effecting that fresh air is conveyed through the air inlet 3 on one hand along the first shell section 61 and on the other hand through the second interior space 22 via the two edge passages 81 into the first interior space 21. As a result, air can be continuously circulated in the device 1, making it possible to cool the laboratory instrument and the auxiliary unit. The flue connection piece 43 is ideally connected directly with the building ventilator, so that no waste heat can get into the laboratory in which the device 1 is located.

Figure 7:
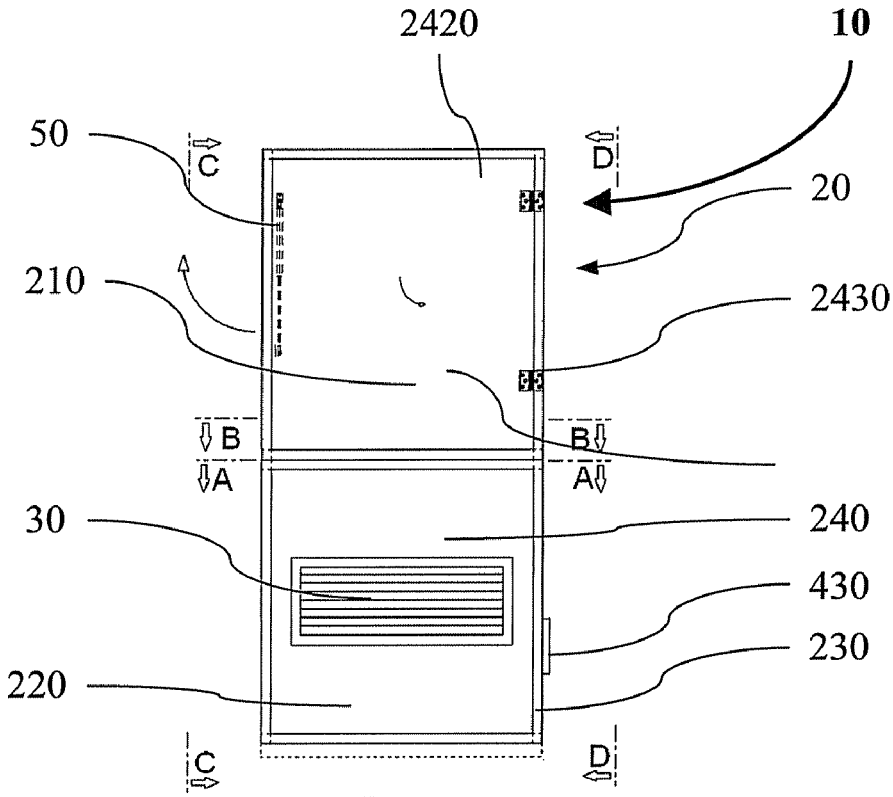
FIG. 7 shows a side view of a second exemplary embodiment of a device according to the invention for reducing noise and heat emissions from a laboratory instrument in a laboratory.

FIG. 7 shows a side view of a second exemplary embodiment of a device 10 according to the invention having a casing 20 with a frame 230 and panels 240 located therein. The panels 240 are tightly connected with the frame 230 so as to form an upper first interior space 210 and a lower second interior space 220 separated from it by an intermediate wall (not visible on FIG. 7). The panel 240 of the interior space 210 shown in the side view on FIG. 7 is arranged as a door 2420 secured to the frame 230 by two hinges 2430, which can be swiveled to the right as shown by the curved arrow, so that the first interior space 210 can be opened, and hence accessed from this side. The interior space accommodates a gas spring 50, with which the swinging gate 2410 shown on FIG. 11 can be opened. An air inlet 30 is arranged on the panel 240 of the second interior space 220 shown in the side view on FIG. 7, through which air can stream into the second interior space 220. On the right of the side view on FIG. 7, the device 10 has a flue connection piece 430 that projects over the casing 20.

Figure 8:
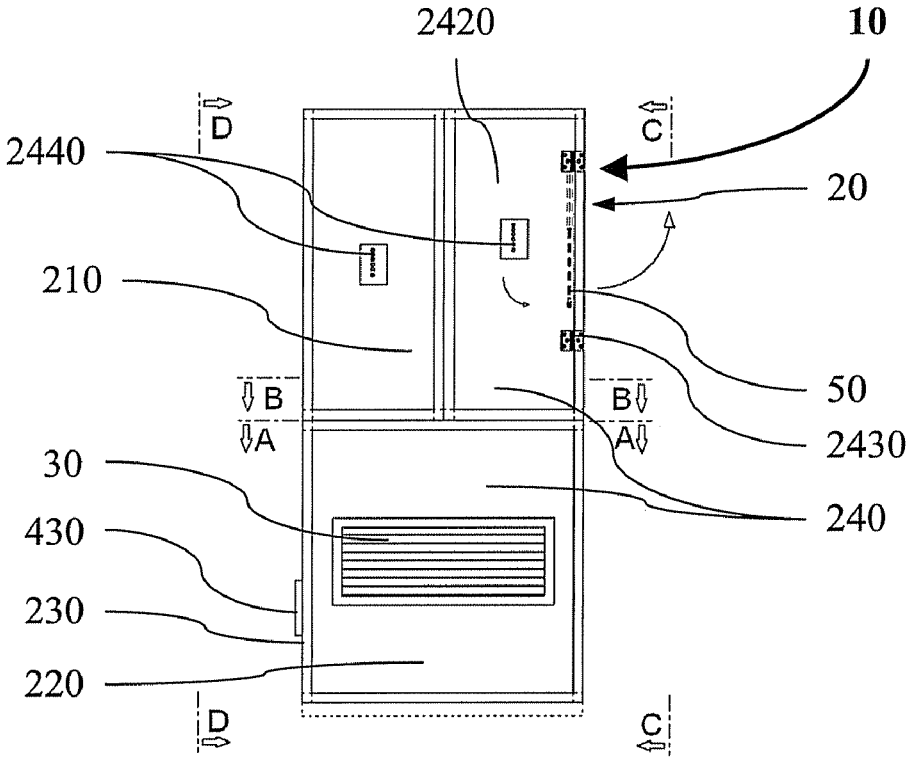
FIG. 8 shows a side view of the device according to FIG. 7 opposite the side view from FIG. 7.

In FIG. 8 a side of the device 10 opposite the side view presented on FIG. 7 is shown, which is essentially similar to the side of the device 10 shown on FIG. 7, except that two horizontally adjacent panels 240 seal the first interior space 21. The right one of these two panels 240 is here arranged as a door 2420 secured to the frame 230 by two hinges 2430, which can be swiveled to the right as shown by the curved arrow, so that the first interior space 210 can be opened, and hence also accessed from this side. The two doors 2420 each have cable passages 2440.

Figure 9:
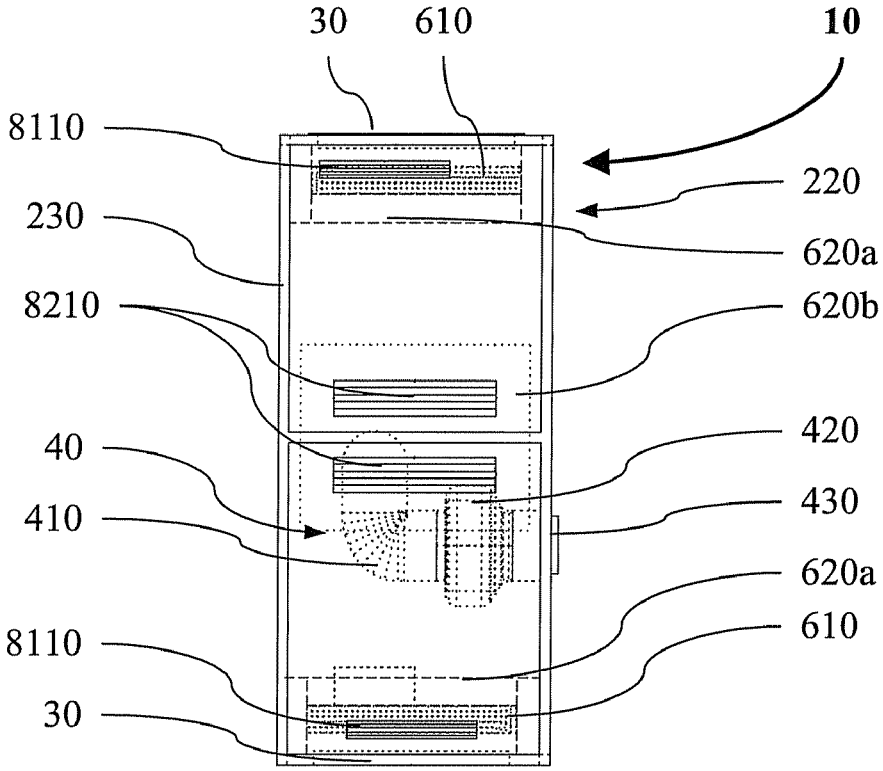
FIG. 9 shows a sectional view along line A-A of the device from FIG. 7 and FIG. 8.

FIG. 9 shows a top view of the second interior space 220, in which two vertical first shell sections 610 are arranged that each cover one of the two air inlets 30, and each are tightly connected with a horizontal outer second shell section 620*a*. A central second shell section 620*b* is arranged in the middle of the device 10. A grid 8110 is situated above each of the two outer second shell sections 620*a*. Two parallel grids 8210 are positioned above the central second shell section 620*b*. Further, a flue 40 with a pipe 410 is located in the second interior space 220. The pipe 410 is connected with the central second shell section 620*b* and flue connection piece 430 in such a way as to let air through. At the pipe 410 a fan 420 is arranged, which can convey air through the pipe 410 from the central second shell section 620*b* out of the flue connection piece 430.

Figure 10:
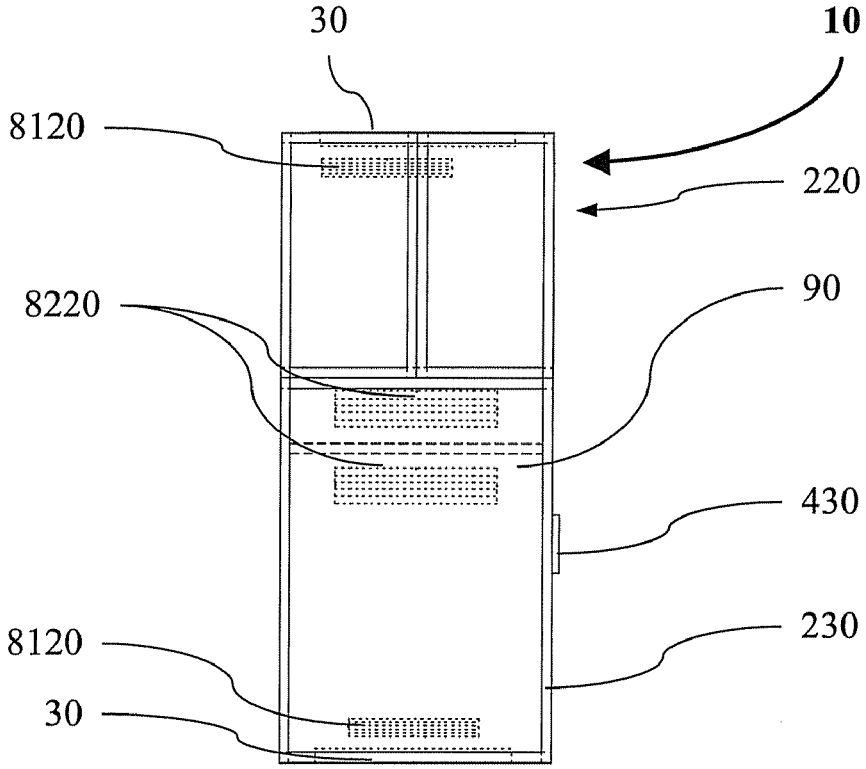
FIG. 10 shows a sectional view along line B-B of the device from FIG. 7 and FIG. 8.

FIG. 10 shows a top view of an intermediate wall 90 that is tightly connected with the frame 230, and separates the first interior space 210 from the second interior space 220. The intermediate wall 90 exhibits perforated screens 8120 and 8220 that each abut the grids 8110 and 8210.

Figure 11:
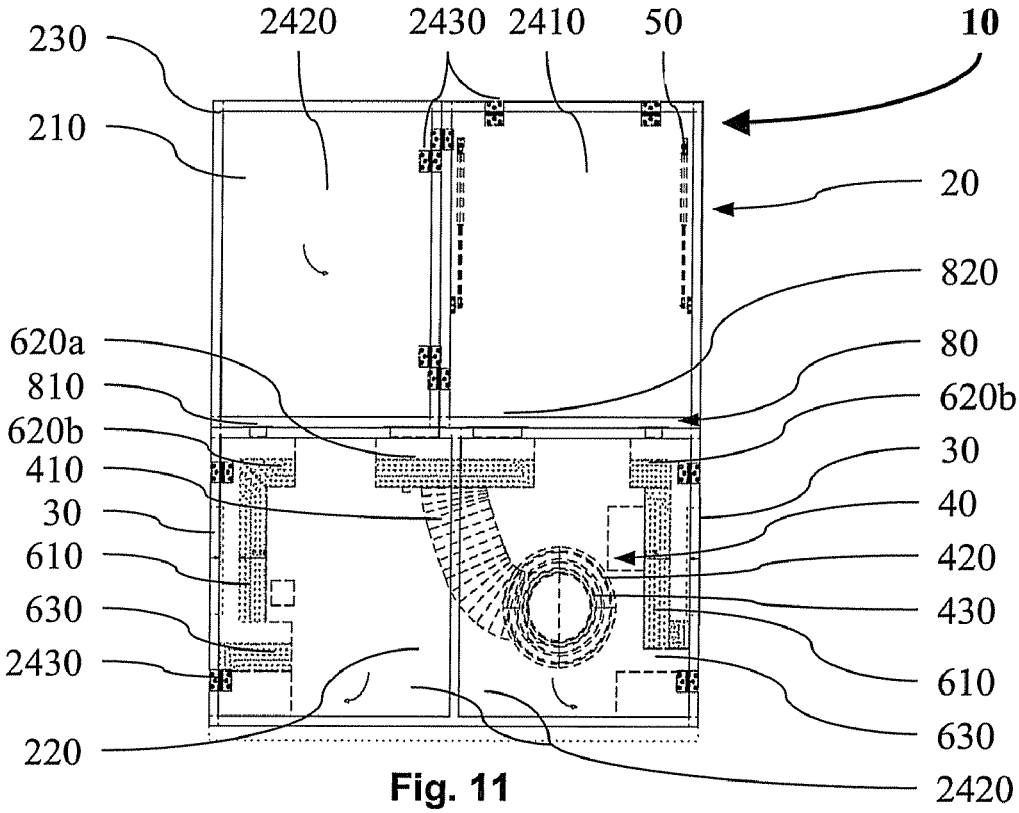
FIG. 11 shows a front view along line C-C of the device from FIG. 7 and FIG. 8.
Figure 12:
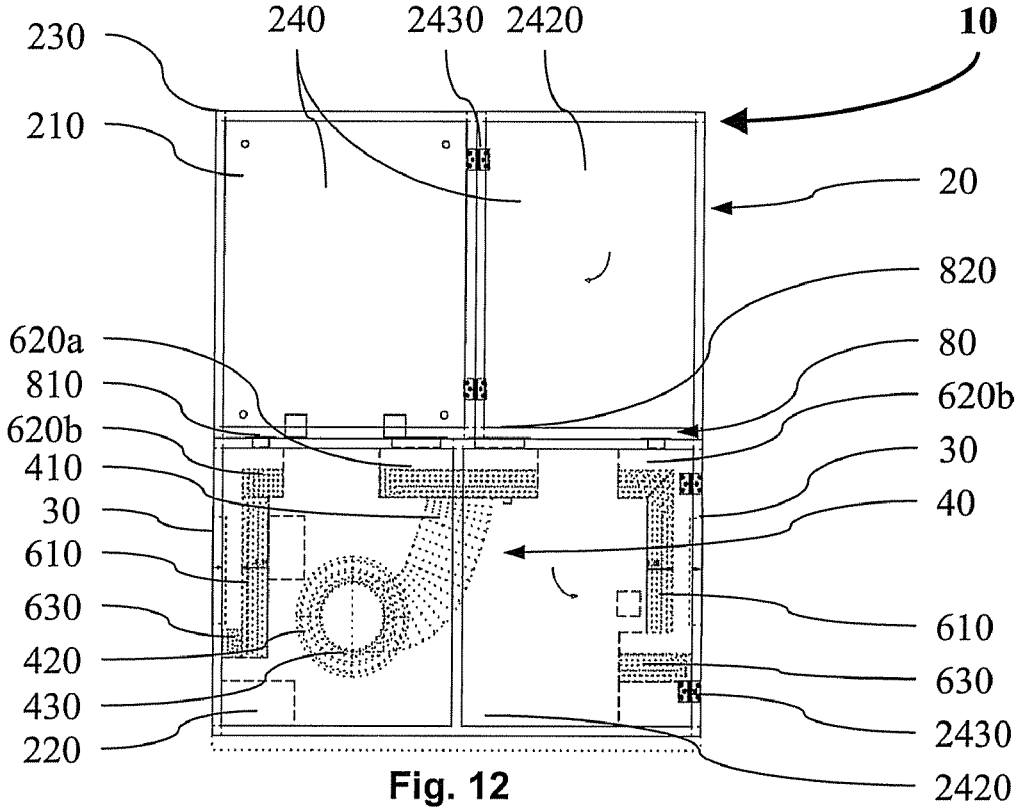
FIG. 12 shows a rear view along line D-D of the device from FIG. 7 and FIG. 8.

FIG. 11 shows the front side of the device 10, while FIG. 12 shows the rear side. Respective two horizontally adjacent panels 240 seal the first interior space 210 each two on the front side of the device 10 and on the rear side of the device 10. The right panel 240 on the front side is here arranged as a swinging gate 2410, while the left panel 240 on the front side and the right panel 240 on the rear side each are arranged as doors 2420 each secured to the frame 230 by two hinges 2430. Respective two horizontally adjacent panels 240 also seal the second interior space 220 each two on the front side of the device and on the rear side of the device 10. The right panel 240 on the front side and the two panels 240 on the rear side are here arranged as doors 2420 each secured to the frame 230 by two hinges 2430.

The two air inlets 30 are each covered by one of the two first shell sections 610 of an insulation shell 60. The lower end of the left of the two first shell sections 610 is tightly connected with a horizontal third shell section 630, while the lower end of the right of the two first shell sections 610 is connected at a distance with another horizontal third shell section 630. Situated between the first interior space 210 and the second interior space 220 an air inlet 80 is arranged, which exhibits two lateral edge passages 810 and two middle central passages 820. The two outer second shell sections 620*a* each cover one of the two edge passages 810, and the central second shell section 620*b* covers the two central passages 820.

Corresponding to the first exemplary embodiment of the invention described above, during operation of the device 10, a laboratory instrument, e.g., a particle accelerator, can be arranged in the first interior space 210 on the intermediate wall 90, and an auxiliary unit, e.g., a vacuum pump, in the second interior space 220. The described configuration of the casing 20 in the area of the first interior space 210 allows the first interior space 210 of the device 10 to be opened from all sides. As a result, the laboratory instrument can also be accessed from all sides, which in turn can be important for the simple monitoring, servicing and maintenance of the laboratory instrument. The massive, sound-absorbing and heat-impermeable construction of the frame 20, panels 240 and insulation shell 60 is also corresponding to the first exemplary embodiment.

In order to cool the interior space 210 and second interior space 220, heated air is relayed through the central passages 820, the pipe 410 and the flue connection piece 430 out of the first interior space 210 and out of the device 10 by the fan 420. This produces an underpressure in the first interior space 210, effecting that fresh air is conveyed through the two air inlets 30 on one hand along the two first shell sections 610 and on the other hand through the second interior space 220 via the two edge passages 810 into the first interior space 210. As a result, air can be continuously circulated in the device 10, making it possible to cool the laboratory instrument and auxiliary unit. The flue connection piece 430 is ideally connected directly with the building ventilator, so that no waste heat can get into the laboratory in which the device 10 is located.

Additional structural variations of the devices according to the invention described above can be realized. Express mention is made of the following ones:

The device can also have just a single interior space, which can be advantageous in particular when using laboratory instruments that require no auxiliary units.

The doors and swinging gates of the device can be optimized to suit device application.

Other materials can be used for the panels and the frame, depending on the laboratory instrument used. For example, the materials can be optimized to the weight of the laboratory instrument and/or its noise and heat production.

The invention claimed is:

1. A device (1; 10) for reducing noise and heat emissions from a laboratory instrument in a laboratory, comprising a casing (2; 20) with sound-absorbing walls (24; 240), wherein the casing (2; 20) forms a first interior space (21; 210) for accommodating the laboratory instrument and a second interior space (22; 220) for accommodating an auxiliary unit, said first and second interior spaces (21, 22; 210, 220) being separated from each other by an intermediate wall (9; 90), wherein at least one of the sound absorbing walls (24; 240) is arranged as a door (241, 242; 2410, 2420) providing access to said first interior space (21; 210), wherein at least one of the sound-absorbing walls (24; 240) has an air inlet (3; 30) in the area of the second interior space (22; 220) for feeding air into the second interior space (2; 220), and wherein a flue (4; 40) is provided in one of the sound absorbing walls (24; 240) in the area of the second interior space (22; 220) for exhausting air out of said second interior space (22; 220), wherein the intermediate wall (9; 90) is provided with at least one inlet passage (81; 810) to pass air from said second interior space (22; 220) to said first interior space (21; 210) and with at least one outlet passage (82; 820) to pass air from said first interior space (21; 210) to said second interior space (22; 220), wherein said second interior space (22; 220) comprises an insulation shell (6; 60) covering said air inlet (3; 30) and being arranged to divert air coming in through said air inlet (3; 30)

to said at least one inlet passage (81; 810), and wherein said second interior space (22; 220) comprises means (41; 410) for directing air from said at least one outlet passage (82; 820) into said flue (4; 40), and wherein said air inlet (3; 30), insulation shell (6; 60), inlet passage (81; 810), outlet passage (82; 820) and flue (4; 40) are arranged so that both the first and second interior spaces (21, 22; 210, 220) of the casing (2; 20) are veritable via the air inlet (3; 30) and the flue (4; 40).

2. The device (1; 10) according to claim 1, wherein the insulation shell (6;60) comprises a first shell section (61; 610), which covers the air inlet (3; 30) from the second interior space (22; 220), and a second shell section (62; 620*a*, 620*b*), which covers the at least one inlet passage (81; 810) and the at least one outlet passage (82; 820) from the second interior space (22; 220), and wherein the first shell section (61; 610) is tightly connected with the second shell section (62; 620*a*, 620*b*).

3. The device (1; 10) according to claim 1, wherein the casing (2; 20) has a frame (23; 230) and panels (24; 240) arranged therein, which are sealedly connected with the frame (23; 230).

4. The device (1; 10) according to claim 3, wherein the panels (24; 240) have a wood core mounted in steel elements.

5. The device (1; 10) according to claim 1, wherein the flue (4; 40) has a fan (42; 420) that is controllable by means of a temperature sensor.

6. The device (1; 10) according to claim 1, wherein one of the walls (24; 240) of the casing (2; 20) is arranged as a door (241, 242; 2410, 2420) for opening the interior space (21, 22; 210, 220).

7. The device (1; 10) according to claim 1, wherein rolls are arranged on the casing (2, 20) for moving the device (1; 10).

8. A device, comprising:

a casing, including an intermediate wall, a first portion of the casing forming a first interior space on a first side of the intermediate wall for accommodating a laboratory instrument and a second portion of the casing forming a second interior space on a second side of the intermediate wall for accommodating an auxiliary unit;

a door assembly disposed at the first portion of the casing to provide access to the first interior space;

an inlet disposed at the second portion of the casing to fluidly communicate with and to provide air to the second interior space; and a flue disposed at the second portion of the casing to fluidly communicate with and to exhaust air out of the second interior space, the intermediate wall being formed to define an inlet passage by which air passes from the second to the first interior space and an outlet passage by which air passes from the first to the second interior space, the device further comprising air directing devices to respectively divert air from the inlet to the inlet passage and from the outlet passage to the flue.

9. The device according to claim 8, wherein the door assembly provides access to the first interior space without exposing the second interior space.

10. The device according to claim 8, wherein the inlet and the outlet passages are plural.

11. The device according to claim 8, wherein air flow through the inlet passage is symmetric with respect to air flow through the outlet passage.

12. The device according to claim 8, wherein the intermediate wall is singularly planar.

13. The device according to claim 8, wherein a single pathway is defined between the inlet and the flue.

14. The device according to claim 13, wherein air flow proceeds through multiple routes between the first and the second interior spaces along the single pathway.

* * * * *